US008593929B1

(12) United States Patent
Perkins

(10) Patent No.: US 8,593,929 B1
(45) Date of Patent: Nov. 26, 2013

(54) MOVING COIL TYPE PICK UP CARTRIDGE ASSEMBLY

(76) Inventor: Allen Perkins, Berkeley, CA (US)

( * ) Notice: Subject to any disclaimer, the term of this patent is extended or adjusted under 35 U.S.C. 154(b) by 0 days.

(21) Appl. No.: 13/570,168

(22) Filed: Aug. 8, 2012

(51) Int. Cl.
*H04R 9/12* (2006.01)

(52) U.S. Cl.
USPC ..... 369/147

(58) Field of Classification Search
USPC ..... 369/147
See application file for complete search history.

(56) References Cited

U.S. PATENT DOCUMENTS 1,752,943 A * 4/1930 Dyer ..... 369/147
1,947,544 A * 2/1934 Bedford ..... 369/135
3,383,474 A * 5/1968 Kriebel et al. ..... 369/146
3,963,880 A * 6/1976 Ikeda ..... 369/136
4,011,417 A * 3/1977 Kageyama et al. ..... 369/147
4,547,874 A * 10/1985 Mori et al. ..... 369/139
4,675,859 A * 6/1987 Croopnick et al. ..... 369/147
4,884,262 A * 11/1989 Larsen et al. ..... 369/136

* cited by examiner

*Primary Examiner* — Angel Castro
(74) *Attorney, Agent, or Firm* — Bay Area Technology Law Group PC

(57) ABSTRACT

A moving coil type pick up capsule having a body, cantilever having first and second ends, a stylus located at its first end and a coil located at its second end and, therebetween, a dampener having an opening therethrough. The cantilever passes through the dampener opening such that the stylus is on a first side of the dampener and the coil is on a second side of the dampener. First and second magnets or yokes are positioned within or proximate the capsule body and spaced from one another to create a gap, the dampener and coil being positioned within the gap such that the fulcrum is located between the stylus and coil and specifically at the dampener. A dampening fluid fills the gap to complete the assembly.

15 Claims, 3 Drawing Sheets

MOVING COIL TYPE PICK UP CARTRIDGE ASSEMBLY

TECHNICAL FIELD

The present invention involves a moving coil type pick up cartridge used for tracking a sound groove of a record disk and providing its output to an amplification system for electronic reproduction.

BACKGROUND OF THE INVENTION

Moving coil cartridges have been used in high fidelity audio systems for translating information contained within grooves of a vinyl record by converting mechanical vibrational energy from a stylus tracking these grooves into an electrical signal that is subsequently amplified and converted to sound by a loudspeaker system.

In a typical moving coil design, a drag wire is included which, when the stylus is tracking the grooves of a moving record, acts as a spring that forces the assembly to return to center and also prevents the assembly from being pulled forward as a result of the friction imposed between the stylus and record surface. Static and dynamic forces imposed upon the stylus and its supporting cantilever act to transfer energy into the cartridge body. This energy is considered spurious and detrimental to that vibratory energy intended to be converted by the cartridge acting as a transducer. Some of this spurious energy is partially absorbed and some of it is partially transferred through the tone aim that supports the cartridge causing colorations that alter the signal.

It is thus an object of the present invention to provide a moving coil type pick up cartridge which significantly reduces the amount of spurious energy created in prior designs by eliminating drag wires and by dampening the fulcrum of the cantilever for improved sound reproduction.

These and further objects will be more readily appreciated when considering the following disclosure and appended claims.

SUMMARY OF THE INVENTION

A moving coil type pick up cartridge having a capsule body, cantilever having first and second ends, a stylus located at its first end and a coil located at its second end and, therebetween, a dampener having an opening therethrough. The cantilever passes through the dampener opening such that the stylus is on a first side of the dampener and the coil is on a second side of the dampener. The dampener acts as a spring and fulcrum for the motor assembly of the cartridge. First and second magnets or pole pieces (yokes) are positioned within or proximate the capsule body and spaced from one another to create a gap, the dampener and coil being positioned within the gap such that the fulcrum is located between the stylus and coil and specifically at the dampener. A dampening fluid is contained with the gap for completing the cartridge.

DETAILED DESCRIPTION OF THE INVENTION

Figure 1:
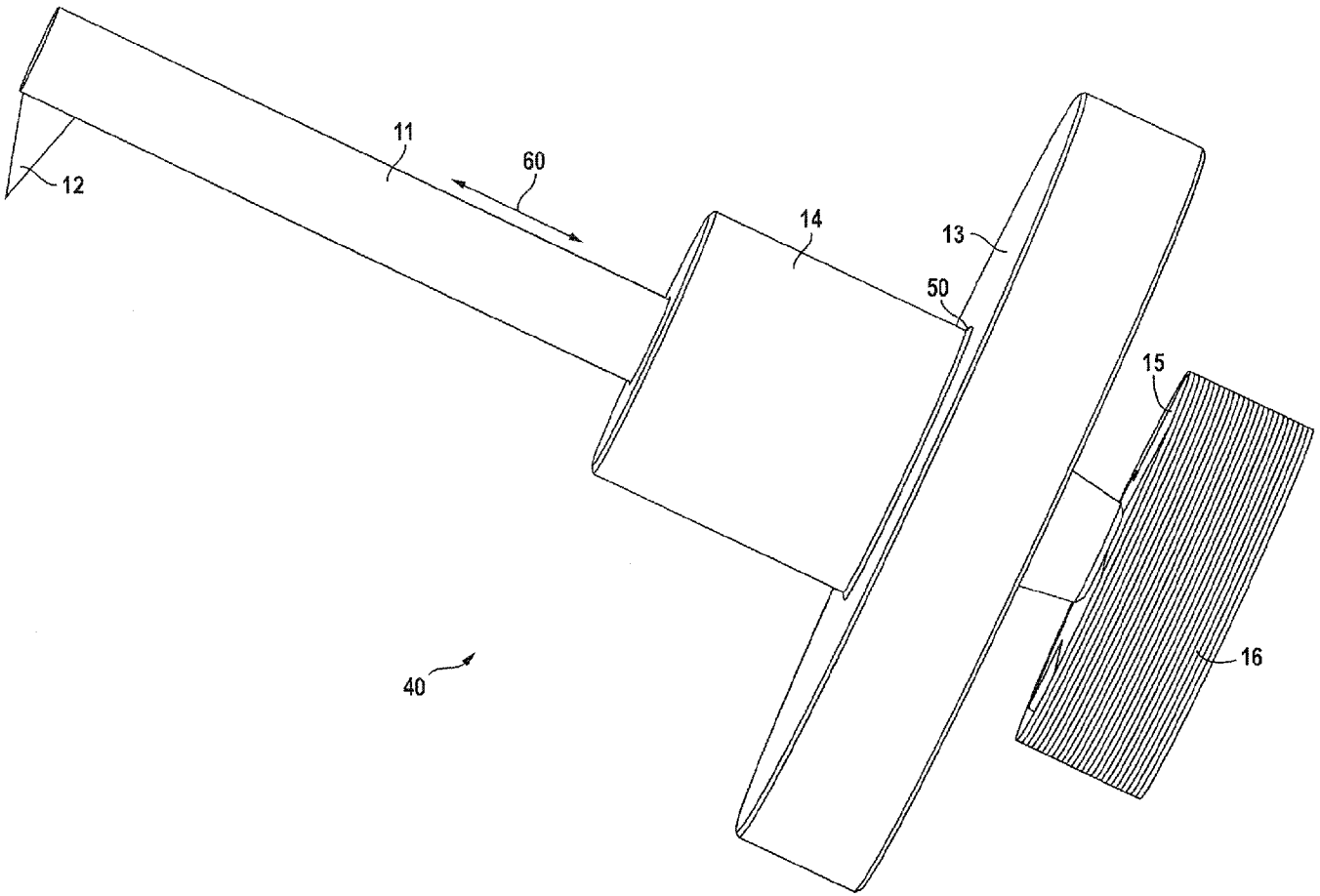
FIG. 1 is a perspective view of the cantilever, dampener and coil former making up a portion of the motor assembly of the present moving coil type pick up cartridge.
Figure 2:
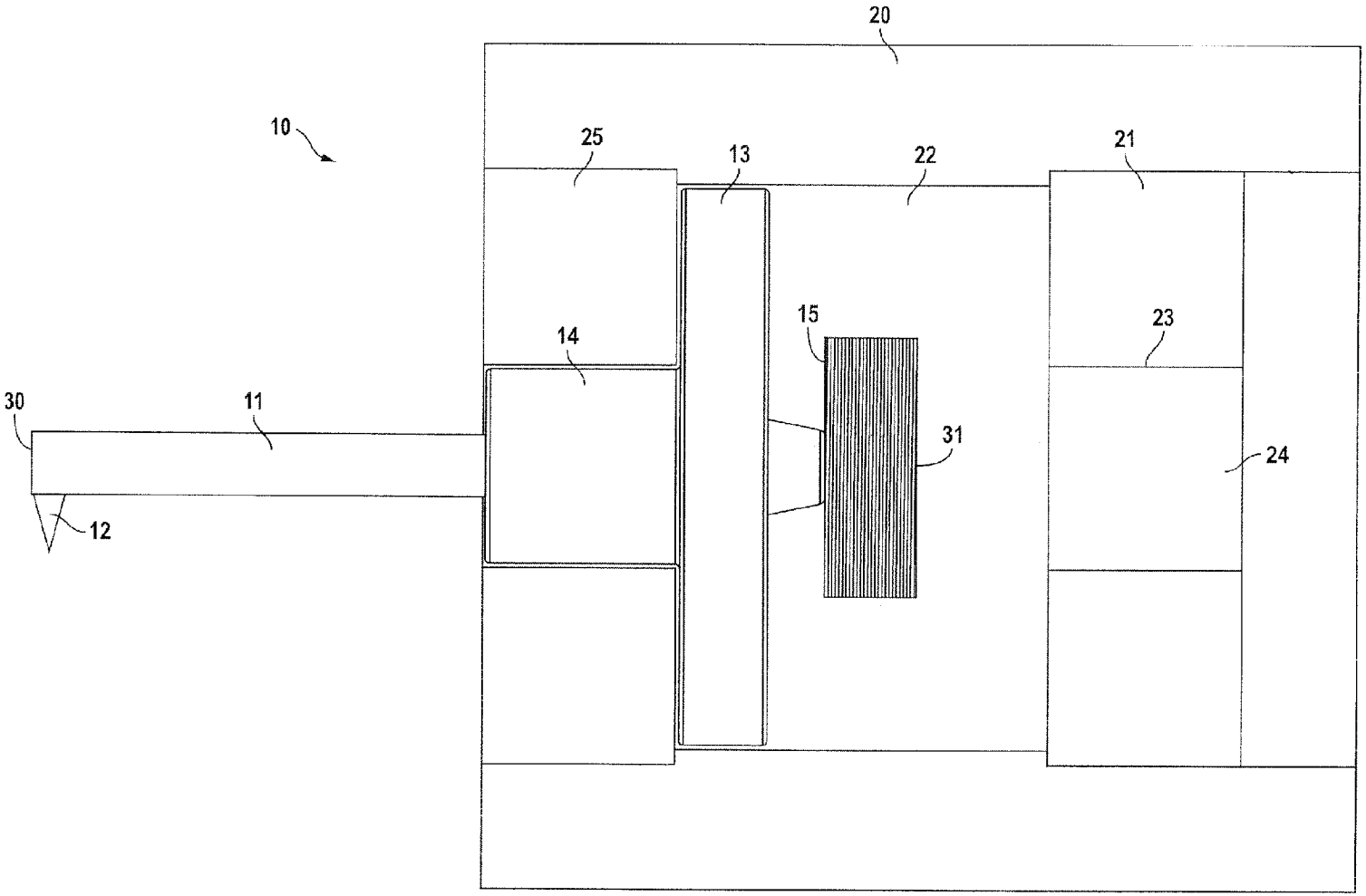
FIG. 2 is a side view of the motor assembly of FIG. 1 placed within a capsule body including appropriately placed magnets for completing the moving coil type pick up cartridge of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

The present invention is directed to a moving coil type pick up cartridge 10 having capsule body 20 housing its motor assembly. Moving coil pick up cartridge 10 includes cantilever 11 having first and second ends 30 and 31. Stylus 12 is located at first end 30 for tracking a sound groove of a record disk (not shown) while second end 31 supports coil former 15 having coil 16 wrapped thereabout.

An important feature of the present invention is that cantilever 11 is partially enclosed in dampener 40 such that the fulcrum of cantilever 11 is within dampener 40 and, specifically, at fulcrum point 50 as shown in FIG. 1. In doing so, spurious energy created in prior designs resulting from use of drag wires is eliminated, the cantilever being further damped by fabricating dampening device 40 from a soft material such as a molded plastic, examples of which are silicone and polyurethane. It is further noted that the fulcrum of cantilever 11 can be adjusted by moving cantilever 11 per arrows 60 thus changing the distance between stylus 12 and fulcrum 50.

In constructing the assembly of FIG. 1 as shown, and particularly in creating the fulcrum of cantilever 11 at 50, dampener 40 having a substantially disk-shaped body is provided having an opening through its geometric center as shown for receiving cantilever 11 with the stylus on one side of the dampener and coil former 15 (supporting cable 16) on its opposite side. Ideally, disk-shaped body 13 is extended by cylindrical extension 14 acting further to dampen cantilever 11 and further reduce spurious energy.

In a first embodiment, capsule body 20 further supports front and rear magnets 25 and 21, respectively, the front magnet 25 having an opening to receive cylindrical portion 14 of dampener 40 while back magnet 21 is provided with opening 23.

Figure 3:
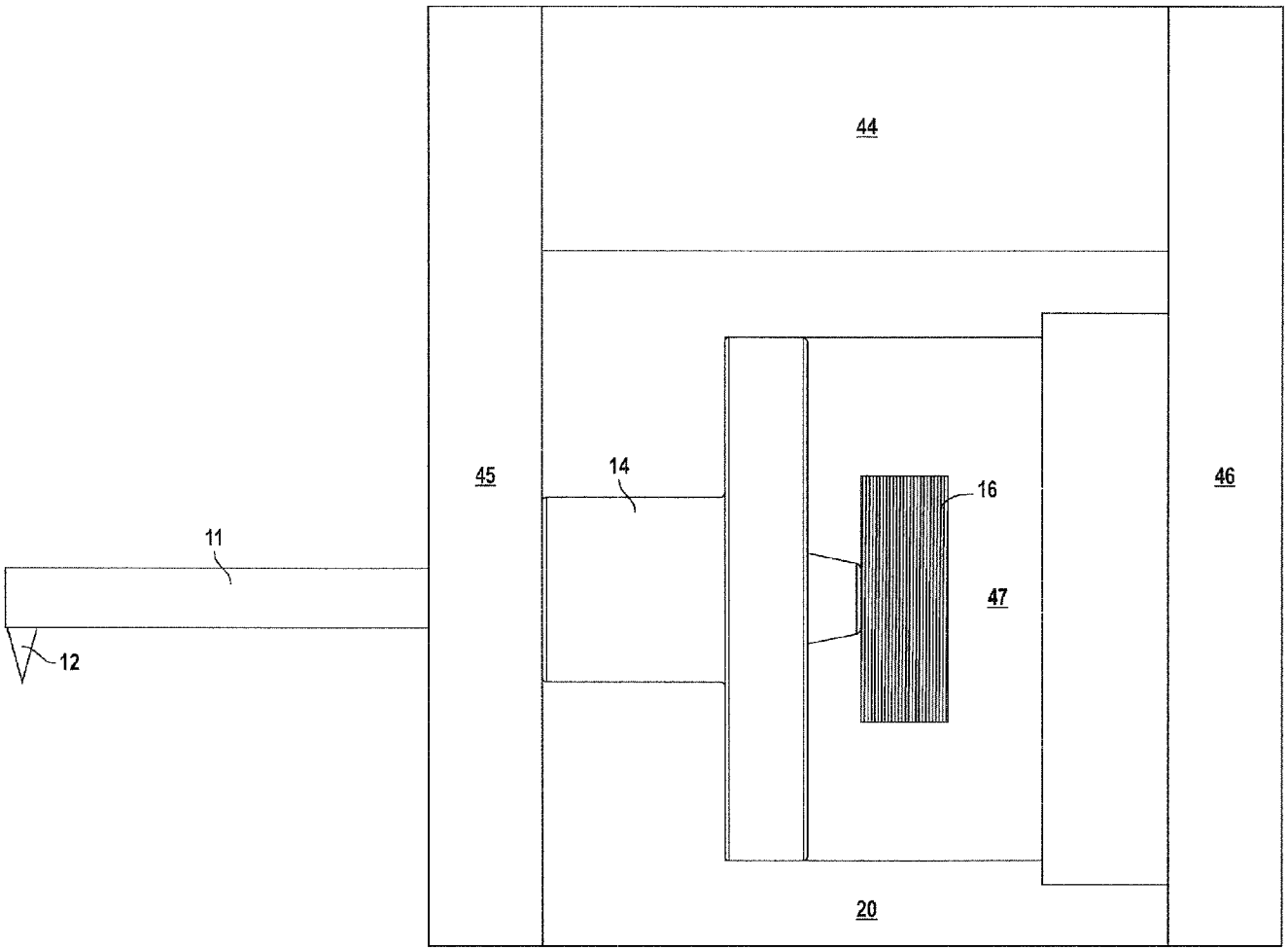
FIG. 3 is a side view of an alternative magnet assembly to that of FIG. 2.

As a second embodiment, reference is made to FIG. 3. Specifically pole pieces (yokes) 45 and 46 can be used to replace magnets 25 and 21 through the use of magnet 44 positioned external to capsule body 20. Ferrofluid can be housed in gap 47 to complete the cartridge.

A distinguishing feature of the present invention is to minimize axial movement of cantilever 11 and, to that end, a dampening fluid is introduced through opening 23 in back magnet 21 substantially filling gap 22 or gap 47. The dampening fluid, such as a ferrofluid, once introduced is sealed within the gap by the application of plug 24.

In practicing the present invention, it is quite apparent that the static and dynamic forces imposed upon the stylus and its supporting cantilever result in the maximum translation of energy to the amplification system and minimizes the transfer of spurious energy into the cartridge body. The drag wire used in current designs is eliminated. Dampener 40 acts as a spring for the cantilever and (adjustable) fulcrum for the motor assembly while centering coils 16 directly between magnets 21 and 25 or yokes 45 and 46.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A moving coil type pick up cartridge comprising a capsule body, a cantilever having first and second ends, a stylus located at said first end for tracking a sound groove of a record disk and said second end terminating in a coil and having a fulcrum therebetween, said coil vibrating in response to vibrations of the stylus, a dampener having an opening therethrough, said cantilever passing through said opening such that said stylus is on a first side of said dampener and said coil is on a second side of said dampener, first and second magnets positioned within said capsule body and spaced from one another to create a gap, said dampener and coil being positioned within said gap such that said fulcrum is located between said stylus and coil and a dampening fluid substantially filling a volume created by said gap.

2. The moving coil type pick up cartridge of claim 1 wherein said fulcrum is located at said dampener.

3. The moving coil type pick up cartridge of claim 1 further comprising an extension emanating from said dampener and extending towards said stylus for centering said cantilever within said capsule body.

4. The moving coil type pick up cartridge of claim 3 wherein said dampener is molded of plastic.

5. The moving coil type pick up cartridge of claim 4 wherein said dampener is comprised of a member selected from the group consisting of silicone and polyurethane.

6. The moving coil type pick up cartridge of claim 1 wherein said cantilever is moveable within said opening in said dampener to alter the distance between said stylus and said dampener.

7. A moving coil type pick up cartridge comprising a capsule body, a cantilever having first and second ends, a stylus located at said first end for tracking a sound groove of a record disk and said second end terminating in a coil and having a fulcrum therebetween, said coil vibrating in response to vibrations of the stylus, a dampener comprising a substantially disk-shaped body and a cylindrical extension emanating therefrom and extending towards said stylus, said cylindrical extension aligned with an opening through the geometric center of said dampener to facilitate said cantilever passing through said opening such that said stylus is on a first side of said dampener and said coil is on a second side of said dampener, said dampener and cylindrical extension comprised of a molded plastic, first and second magnets positioned within said cartridge body and spaced from one another to create a gap, a dampening fluid contained within said cartridge body substantially filling a volume created by said gap, said dampener and coil being positioned within said gap such that said fulcrum of said cantilever is located at said dampener.

8. The moving coil type pick up cartridge of claim 7 wherein said plastic is a member selected from the group consisting of silicone and polyurethane.

9. The moving coil type pick up cartridge of claim 1 or 7 wherein said dampening fluid is a ferrofluid.

10. A moving coil type pick up cartridge comprising a capsule body, a cantilever having first and second ends, a stylus located at said first end for tracking a sound groove of a record disk and said second end terminating in a coil and having a fulcrum therebetween, said coil vibrating in response to vibrations of the stylus, a dampener having an opening therethrough, said cantilever passing through said opening such that said stylus is on a first side of said dampener and said coil is on a second side of said dampener, first and second pole pieces positioned proximate said capsule body and coupled to a magnet and spaced from one another to create a gap, said dampener and coil being positioned within said gap such that said fulcrum is located between said stylus and coil and a dampening fluid substantially filling a volume created by said gap.

11. The moving coil type pick up cartridge of claim 10 wherein said fulcrum is located at said dampener.

12. The moving coil type pick up cartridge of claim 10 further comprising an extension emanating from said dampener and extending towards said stylus for centering said cantilever within said capsule body.

13. The moving coil type pick up cartridge of claim 12 wherein said dampener is molded of plastic.

14. The moving coil type pick up cartridge of claim 13 wherein said dampener is comprised of a member selected from the group consisting of silicone and polyurethane.

15. The moving coil type pick up cartridge of claim 10 wherein said dampening fluid is a ferrofluid.

* * * * *